US006753811B2

(12) United States Patent
Schumacher

(10) Patent No.: US 6,753,811 B2
(45) Date of Patent: Jun. 22, 2004

(54) SYSTEM FOR PHASE TRIMMING OF FEEDER CABLES TO AN ANTENNA SYSTEM BY A TRANSMISSION PILOT TONE

(75) Inventor: Friedrich Schumacher, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/265,907

(22) Filed: Oct. 8, 2002

(65) Prior Publication Data

US 2003/0080900 A1 May 1, 2003

(30) Foreign Application Priority Data

Oct. 8, 2001 (DE) ..... 101 49 553
Oct. 8, 2001 (EP) ..... 01123993

(51) Int. Cl.[7] ..... H01Q 3/22
(52) U.S. Cl. ..... 342/368; 342/372
(58) Field of Search ..... 342/165, 174, 342/368, 372

(56) References Cited

U.S. PATENT DOCUMENTS 4,532,518 A 7/1985 Gaglione et al.
4,739,334 A * 4/1988 Soref ..... 342/368
5,517,686 A * 5/1996 Kennedy et al. ..... 455/273
5,532,706 A * 7/1996 Reinhardt et al. ..... 343/778

FOREIGN PATENT DOCUMENTS

| | | |
|---|---|---|
| DE | 199 48 039 A1 | 5/2000 |
| DE | 199 25 868 A1 | 1/2001 |
| GB | 2 342 505 A | 4/2000 |
| WO | WO 99/63619 | 12/1999 |

* cited by examiner

*Primary Examiner*—Dao Phan
(74) *Attorney, Agent, or Firm*—Staas & Halsey LLP

(57) ABSTRACT

A system for phase trimming of feeder cables, which are used for driving an antenna system uses a transmission pilot tone. A pilot tone device, which is arranged on the transmission side, produces the transmission pilot tone, which is input into each individual one of the feeder cables and is in each case passed, as a received pilot tone, to an output device which is connected upstream of the antenna system. Using the latter, the pilot tone is output from the respective feeder cable, and is processed further in order to determine phase differences between the feeder cables. The phase differences between the feeder cables determined in this way are compensated for by a trimming device, which is arranged between the input device and the feeder cables.

22 Claims, 2 Drawing Sheets

SYSTEM FOR PHASE TRIMMING OF FEEDER CABLES TO AN ANTENNA SYSTEM BY A TRANSMISSION PILOT TONE

CROSS REFERENCE TO RELATED APPLICATIONS

This application is based on and hereby claims priority to German Application No. 101 49 553.6 filed on Oct. 8, 2001 and European Application No. 011 23 993.6 filed on Oct. 8, 2001, the contents of which are hereby incorporated by reference.

BACKGROUND OF THE INVENTION

The invention relates to a system for phase trimming of N feeder cables, which are used for driving an antenna system, by a transmission pilot tone.

Radio communications systems use antenna systems with individual antennas which are driven via feeder cables. These feeder cables influence the polar diagram of the antenna system as a result of mechanical length differences and phase differences between them, for which reason the phase differences must not exceed maximum values, which are predetermined on a system-dependent basis.

In the case of a phased array antenna system which comprises N individual antennas and is used in so-called switched-beam radio communications systems an N×N Butler matrix, for example, is connected upstream in order to drive the N individual antennas. A total of N feeder cables are arranged between the Butler matrix and a transmission device, and are intended to be essentially of the same length, for example for specific applications. A maximum permissible phase difference of ±5°, by way of example, is required, as a typical value, between the individual feeder cables.

The lengths of the feeder cables are in this case normally trimmed before the antenna arrangement is brought into use, in such a way that a network analyzer is first of all used to determine any phase difference between the individual feeder cables, with respect to one feeder cable which is used as a reference cable, and the phases are then trimmed to a standard phase by appropriate shortening of the individual feeder cables. A part of the feeder cable on a basic length is advantageously in the form of a so-called jumper cable, whose basic length is preferably used for phase trimming.

The feeder cable phases are preferably trimmed in situ, since the electrical lengths of the feeder cables vary during installation on site, due to bends in the feeder cables. Once the radio communications system, or its antenna systems, has or have been successively commissioned, there is no longer any provision for checking the phase trimming or the phase difference in detail, and this process cannot be carried out during operation of the antenna system.

The network analyzer, which is used for example by an installation team to determine the phase difference, is normally a relatively expensive laboratory item and is suitable only to a restricted extent for commissioning on site, due to its weight, its mechanical dimensions, and due to its sensitivity to environmental influences.

One possible object of the present invention is therefore to allow simpler phase trimming of feeder cables in an antenna system, without complex test equipment and without any restrictions relating to the time at which the measurement is carried out, the time taken to carry out the measurement, and the operating condition of the antenna system.

SUMMARY OF THE INVENTION

According to one aspect of the invention, a transmission pilot tone is input with a time offset, that is to say successively, into each individual feeder cable, and is output again as a received pilot tone after in each case passing through the appropriate feeder cable. The comparison between the transmission pilot tone and the received pilot tone makes it possible to determine phase differences between the feeder cables and to correct for these phase differences as appropriate by a trimming device which is connected upstream of the feeder cables.

The system allows phase trimming both before commissioning and during operation of the antenna system, and is advantageously carried out by a trimming device, which can be operated externally by a servicing team.

A phase control element for phase trimming is in this case provided in the trimming device, for each individual one of the total of N feeder cables. In one advantageous development, these N phase control elements are in the form of differential rotary capacitors, which can operated externally, so that there is no need for complex electrical driving of the phase control elements.

Coarse trimming of the lengths of the feeder cables and the fitting of waterproof connectors at both ends are advantageously carried out in the factory, while only fine trimming of the phase difference is now carried out on site, by the phase control elements. The already described problem of moisture ingress is avoided, and costs and labor time are saved.

The phase differences are determined via a serial interface by a commercially available laptop, which acts as a local maintenance terminal (LMT).

The system advantageously allows the phase differences between the feeder cables to be determined at different frequencies, thus resulting in an improvement in the accuracy of the phase trimming.

The transmission pilot tone which is input into the individual feeder cables in this case satisfies the criteria, as defined in the ETSI specifications, for so-called spurious emission of a carrier frequency, since the transmission pilot tone is in fact likewise passed to the antenna system for transmission.

The carrier frequencies which are used for the transmission pilot tone are advantageously slightly below a lower frequency band limit, which is predetermined as a function of the system, or are slightly above an upper frequency band limit. This offers the advantage that no carrier frequencies that are used for transmissions are located in the vicinity of these carrier frequencies, but at most intermodulation products. In addition, duplex filters which are used as receiving and transmission bandpass filters do not start to produce attenuation in this frequency range.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
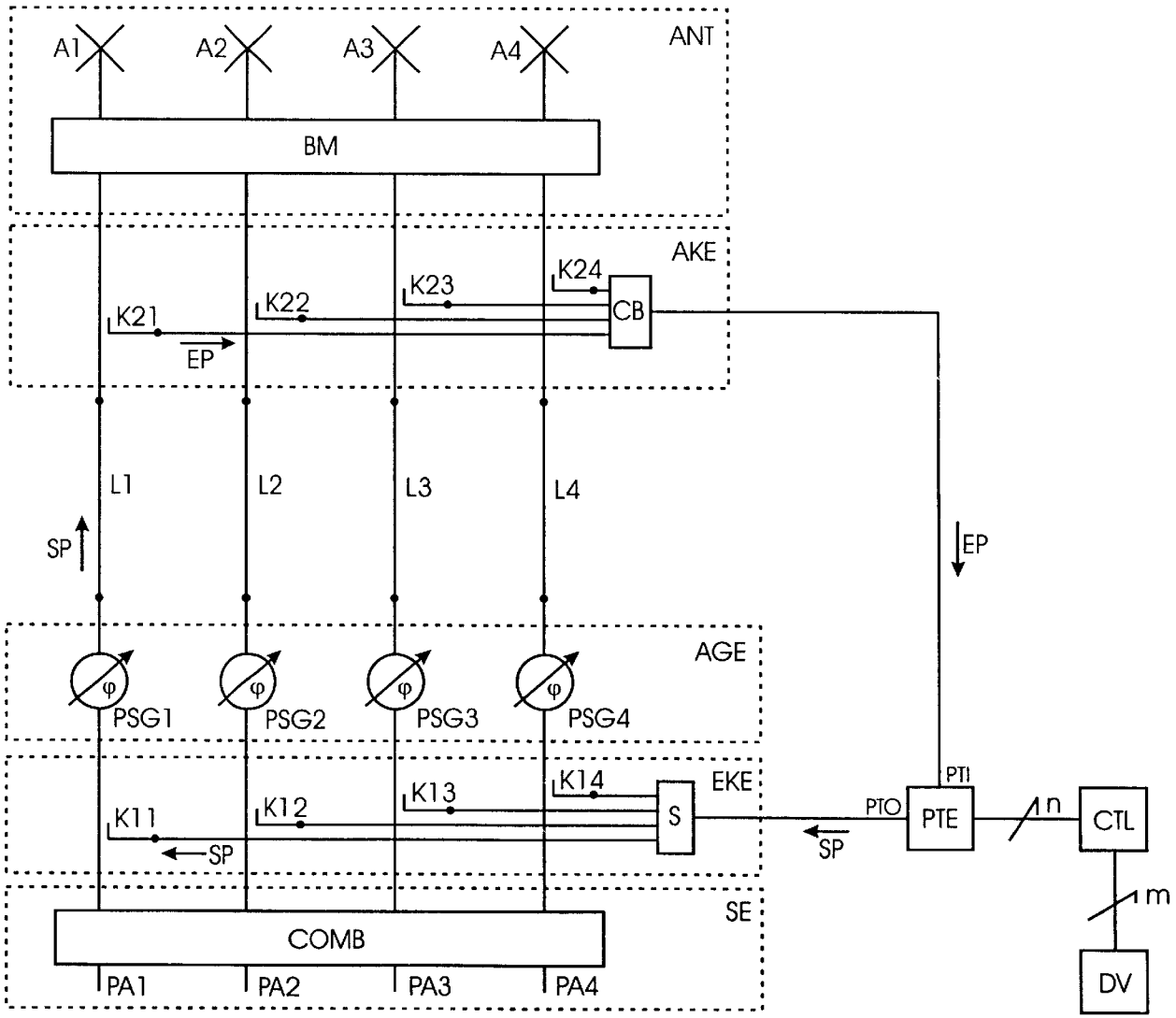
FIG. 1 shows a system according to one aspect of the invention for determining and trimming any phase difference between feeder cables to an antenna system.

Reference will now be made in detail to the preferred embodiments of the present invention, examples of which are illustrated in the accompanying drawings, wherein like reference numerals refer to like elements throughout.

FIG. 1 shows a system according to one aspect of the invention for determining and for trimming any phase difference between N=4 feeder cables L1, L2, L3, L4, which are used for driving an antenna system ANT. The feeder cables L1 to L4 are firstly connected to an output device AKE, which is connected upstream of the antenna system ANT, and are secondly connected via a trimming device AGE and an input device EKE to a transmission device SE.

A transmission pilot tone SP is passed to the input device EKE, by which it is passed via the trimming device AGE, with a time offset, to each individual one of the feeder cables L1 to L4. By the output device AKE, it is output again as a respective received pilot tone EP from the corresponding feeder cable L1, L2, L3, L4. Any relative phase differences between the feeder cables L1 to L4 are then determined, and are corrected by the trimming device AGE, in accordance with system-dependent prerequisites.

In order to trim the phase difference, the trimming device AGE has a respective controllable phase control element PSG1, PSG2, PSG3, PSG4 for each individual one of the feeder cables L1 to L4, in each case in the form of a differential rotary capacitor which can be operated externally.

The input device EKE has a switch S with an input for receiving the transmission pilot tone SP and first to N-th outputs, which are respectively associated with the first to N-th feeder cables L1 to L4. Each of the N outputs of the switch S is followed by a respective coupler K11, K12, K13, K14, such that the transmission pilot tone SP is input, in each case with a time offset, successively by the switch S, into each individual one of the feeder cables L1 to L4.

In order to output the received pilot tone EP from the respective feeder cable L1 to L4, the output device AKE has first to N-th couplers K21, K22, K23, K24, which are associated with the respective first to N-th feeder cables L1 to L4, and a combiner CB, via which the respectively output received pilot tone EP is passed via a pilot tone input PTI to a pilot tone device PTE for further signal processing.

The transmission pilot tone SP is produced by the pilot tone device PTE, and is passed via a pilot tone output PTO to the input device EKE.

By way of example, this description is based on the transmission pilot tone SP being input via the switch S and the coupler K11 into the feeder cable L1. It is output again by the coupler K21 as a received pilot tone EP, which is passed via the combiner CB to the pilot tone device PTE.

The pilot tone device PTE is connected via n data outputs to a monitoring device CTL which is connected downstream from it and downstream from which, for example, a laptop DV is connected via m lines, as an LMT terminal. The phase differences between the feeder cables L1 to L4 can be determined by the laptop DV.

In this example, the antenna system ANT is in the form of a phased array antenna system with four individual antennas A1, A2, A3, A4, which are driven via a Butler matrix BM, which is connected upstream of the antenna system ANT. The transmission device SE includes a combiner COMB with four outputs for feeding signals into the four feeder cables L1 to L4, and four inputs for receiving input signals PA1, PA2, PA3, PA4.

Figure 2:
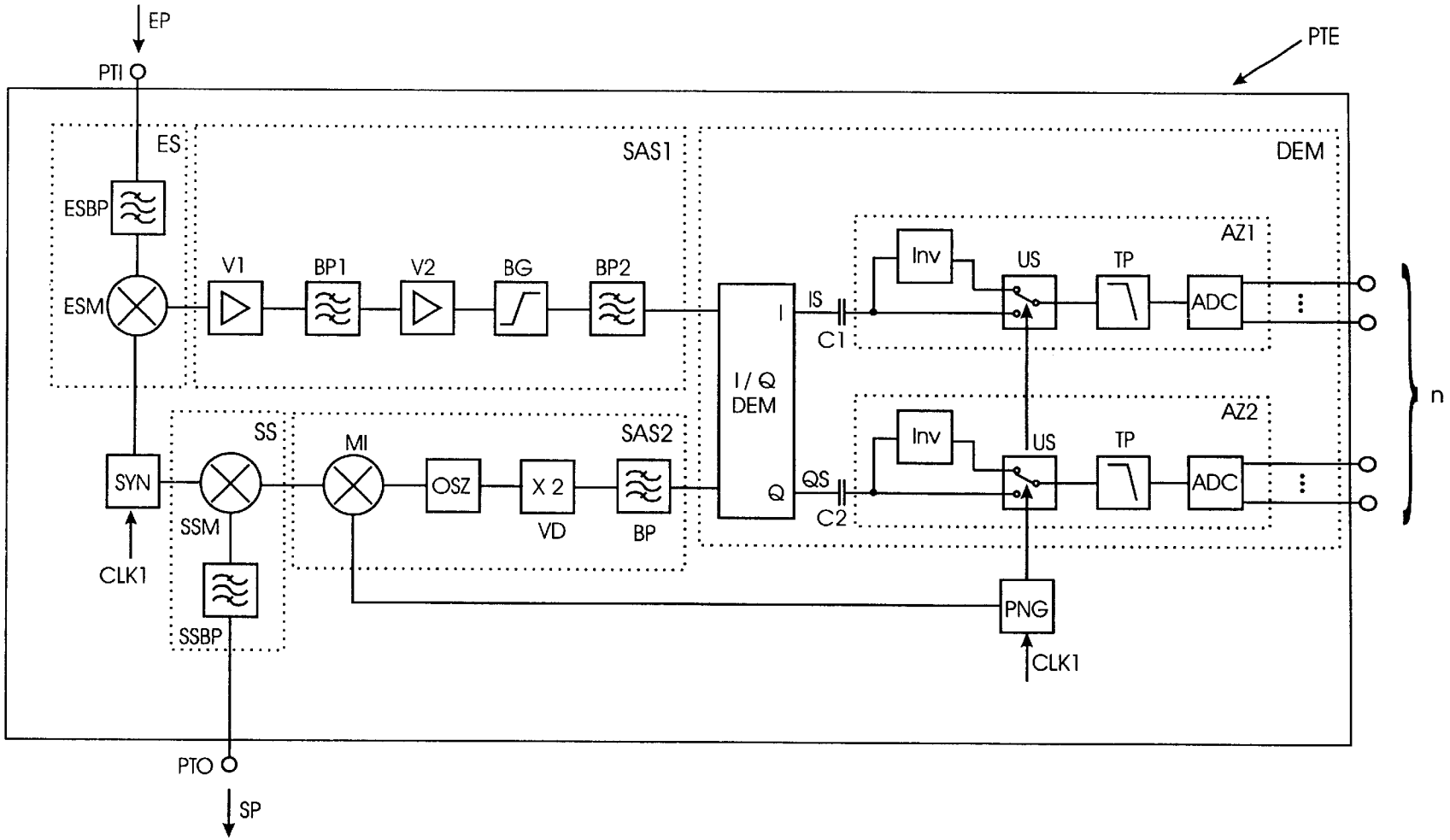
FIG. 2 shows a circuit example of the implementation of a pilot tone device according to one aspect of the invention, as used in FIG. 1.

FIG. 2 shows a circuit example relating to the implementation of the pilot tone device PTE illustrated in FIG. 1.

The pilot tone device PTE has a receiving circuit ES which is connected to the pilot tone input PTI, a transmission circuit SS which is connected to the pilot tone output PTO, a first and a second signal preprocessing circuit SAS1 and SAS2, respectively, and a demodulation device DEM.

The demodulation device DEM is connected via the signal preprocessing circuit SAS1 to the receiving circuit ES, and via the signal preprocessing circuit SAS2 to the transmission circuit SS. A synthesizer SYN which is clocked by a clock signal CLK1 is used for feeding a synthesizer signal into the receiving circuit ES and into the transmission circuit SS. A pseudo noise generator PNG, which is clocked with the clock signal CLK1, is used for feeding a pseudo noise signal into the second signal preprocessing circuit SAS2, and into the demodulation device DEM.

The receiving circuit ES has a receiving mixer ESM, to which, on the input side, the received pilot tone EP is supplied via a reception bandpass filter ESBP, on the one hand, and the synthesizer signal from the synthesizer SYN is supplied, on the other hand, and whose output is connected to the first signal preprocessing circuit SAS1.

In order to allow synchronous detection of the received pilot tone EP, the same synthesizer SYN is used for forming the transmission pilot tone SP and for analysis of the received pilot tone EP.

The first signal preprocessing circuit SAS1 has a series circuit formed from a first amplifier V1, a first bandpass filter BP1, a second amplifier V2, a limiter BG and a second bandpass filter BP2. An output signal, which is formed by the first signal preprocessing circuit SAS1, is applied as a first input signal to the demodulator DEM.

The second signal preprocessing circuit SAS2 has a series circuit formed by a mixer MI, an oscillator OSZ, a doubler VD and a bandpass filter BP. A first output signal, which is formed by the mixer MI from a signal from the oscillator OSZ and from the pseudo noise signal supplied by the pseudo noise generator BNG, is applied to the transmission circuit SS.

A signal which is formed by the doubler VD from the signal from the oscillator OSZ is applied as a second input signal to the demodulation device DEM, after passing through the bandpass filter BP.

The transmission circuit SS has a transmission mixer SSM, to the input side of which the first output signal from the mixer MI in the second signal preprocessing circuit SAS2 and the synthesizer signal are supplied, and whose output is connected to a transmission bandpass filter SSBP, whose output signal forms the transmission pilot tone SP.

The demodulation device DEM has an I/Q demodulator I/Q-DEM with two outputs I and Q, respectively, which are coupled via a respective capacitor C1 or C2 to a respective output path AZ1 or AZ2, for further processing of a respective I signal IS or Q signal IQ supplied by the I/Q demodulator. The first and the second input signals to the demodulation device DEM are supplied as input signals to the I/Q demodulator I/Q-DEM.

The first and the second output paths AZ1 and AZ2, respectively, of the demodulation device DEM each have an inverter INV, a changeover switch US, a low-pass filter TP and an analog-digital converter ADC, with the I signal IS or the Q signal QS being passed either via the inverter INV or directly to the low-pass filter TP via the changeover switch US, as a function of the pseudo noise signal controlling it.

A signal which is passed from the respective low-pass filter TP to the corresponding analog-digital converter ADC is passed as a digital data signal to a total of n data outputs of the pilot tone device PTE.

The following dimensions are adopted by way of example for dimensioning in a GSM 900 radio communications system.

The reception bandpass filter ESBP and the transmission bandpass filter SSBP each have a pass band from 935 to 960 MHz.

The bandpass filters BP1 and BP2 in the first signal preprocessing circuit SAS1 each have a bandwidth of 1.6 MHz. The bandpass filter BP in the second signal preprocessing circuit SAS2 has a pass frequency of 221 MHz.

The low-pass filters TP in the two output paths AZ1 and AZ2 of the demodulation device DEM have a cut-off frequency of 30 Hz.

The synthesizer SYN supplies synthesizer signals at a frequency of 824 MHz or 850 MHz, the clock frequency CLK1 of the synthesizer SYN and of the pseudo noise generator PNG is at a frequency of 1 MHz, while the signal from the oscillator OSZ is at a frequency of 110.6 MHz.

The output signal from the receiving mixer ESM is advantageously at a frequency of 110.6 MHz, since suitable SAW filters are available in this frequency range. The signal preprocessed there can be limited by the limiter BG since, subsequently, it is required only for phase measurement and is synchronously demodulated by the oscillator OSZ at 110.6 MHz.

The I/Q demodulator I/Q-DEM, which is provided for this purpose, for producing the I signal IS and the Q signal IQ as 90° vectors divides the frequency of the signals which are supplied to it, for which reason the oscillator OSZ is followed in an appropriate manner by a doubler VD.

Owing to the synchronization which is required for evaluation of the phase difference, the transmission pilot tone SP is composed of the synthesizer signal and of an intermediate-frequency oscillator signal.

The transmission pilot tone SP and the received pilot tone EP, respectively, are phase-modulated and demodulated with the pseudo noise signal. This results in a spread of approximately 1 MHz. During synchronous demodulation by the I/Q demodulator I/Q-DEM, the I signal and the Q signal are produced in baseband as the modulation signal. These two signals are each capacitively coupled, in order to eliminate any offset caused by the I/Q demodulator. The two output signals from the I/Q demodulator I/Q-DEM together with the pseudo noise signal are then sampled back via the changeover switch US, resulting in a DC voltage with virtually no offset. At the same time, any interference signals that may be present are "broadly sampled" in their frequency, and are effectively filtered away by the simple low-pass filter TP in the respective output path AZ1 or AZ2. A DC voltage produced in this way is then converted to digital data signals by the analog-digital converter ADC in each of the two output paths AZ1 and AZ2, and these digital data signals are passed to the n data outputs of the pilot tone device PTE.

A level of +42 dBm is calculated as the maximum power at the input of the antenna system ANT when a 2:1 combiner CB is advantageously used in the output device AKE. A permissible intermodulation separation level of 70 dB thus results in an intermodulation level of −28 dBM.

A maximum permissible level for radiated interference emission (spurious emission) is −36 dBm. Taking into account an additional margin of 6 dB, this then results in a feasible signal-to-noise ratio for the transmission pilot tone and the received pilot tone of approximately −14 dB.

The invention has been described in detail with particular reference to preferred embodiments thereof and examples, but it will be understood that variations and modifications can be effected within the spirit and scope of the invention.

What is claimed is:

1. A system for phase trimming of N feeder cables, which are used for driving an antenna arrangement, by a transmission pilot tone, comprising:

a trimming device connected to a first end of the feeder cables, to correct phase differences between the N feeder cables;

an input device connected to the trimming device to successively input a transmission pilot tone to the first end of the N feeder cables via the trimming device;

a transmission device to which the N feeder cables are connected via the trimming device and the input device;

an output device connected to a second end of the N feeder cables, between the N feeder cables and the antenna system, to output the transmission pilot tone as a received pilot tone; and a detection unit to detect phase differences between the N feeder cables using the received pilot tone so that phase differences can be corrected by the trimming device.

2. The system as claimed in claim 1, wherein the trimming device has a controllable phase control element for phase trimming, associated with each of the respective N feeder cables.

3. A system for phase trimming of N feeder cables, which are used for driving an antenna arrangement, by a transmission pilot tone, comprising:

a trimming device connected to a first end of the feeder cables, to correct phase differences between the N feeder cables;

an input device connected to the trimming device to successively input a transmission pilot tone to the first end of the N feeder cables via the trimming device;

a transmission device to which the N feeder cables are connected via the trimming device and the input device;

an output device connected to a second end of the N feeder cables, between the N feeder cables and the antenna system, to output the transmission pilot tone as a received pilot tone; and a detection unit to detect phase differences between the N feeder cables using the received pilot tone so that phase differences can be corrected by the trimming device, wherein the input device comprises:

a switch with an input for receiving the transmission pilot tone, and N outputs, which are respectively allocated to the N feeder cables; and a coupler for inputting the transmission pilot tone into the appropriate feeder cable, the coupler receiving the transmission pilot tone and being connected downstream from each of the N outputs of the switch.

4. The system as claimed in claim 1, wherein the output device comprises:

N couplers, which are respectively associated with the N feeder cables for outputting the received pilot tone from the N feeder cables;

a combiner connected the N couplers, to combine the pilot tone received from the N feeder cables and produce a combined signal; and a pilot tone device to receive the combined signal for further signal processing.

5. The system as claimed in claim 4, wherein the pilot tone device comprises:

a pilot tone input connected to the combiner to receive the combined signal; and a pilot tone output connected to the input device for feeding the transmission pilot tone into the input device.

6. The system as claimed in claim 5, further comprising:

a monitoring device connected downstream from the pilot tone device to receive data from the pilot tone device; and a local maintenance terminal which is connected to the monitoring device, to detect phase differences between the feeder cables.

7. The system as claimed in claim 4, wherein the pilot tone device further comprises:

a receiving circuit connected to the pilot tone input;

a transmission circuit which is connected to the pilot tone output;

first and a second signal preprocessing circuits;

a demodulation device which is connected via the first signal preprocessing circuit to the receiving circuit and connected via the second preprocessing circuit to the transmission circuit;

a synthesizer, which is clocked by a clock signal, for feeding a synthesizer signal into the receiving and transmission circuits; and a pseudo noise generator, which is clocked by the clock signal, for feeding a pseudo noise signal into the second signal preprocessing circuit and into the demodulation device.

8. The system as claimed in claim 7, wherein the receiving circuit comprises:

a reception band pass filter; and a receiving mixer having two inputs and an output, a first of the inputs receiving the received pilot tone via the reception bandpass filter, a second of the inputs receiving the synthesizer signal, and the output being connected to the first signal preprocessing circuit.

9. The system as claimed in claim 7, wherein the first signal preprocessing circuit comprises a series circuit formed by a first amplifier, a first bandpass filter, a second amplifier, a limiter and a second bandpass filter.

10. The system as claimed in claim 7, wherein the second signal preprocessing circuit comprises a mixer, an oscillator, a doubler and a bandpass filter arranged in series in that order, the mixer has two inputs and produces a first output signal, the two inputs of the mixer are connected respectively to an output signal of the oscillator and to the pseudo noise signal, the first output signal from the mixer is applied to the transmission circuit, and the bandpass filter produces a second output signal, which is applied to the demodulation device.

11. The system as claimed in claim 10, wherein the transmission circuit comprises:

transmission bandpass filter; and a transmission mixer having two inputs and an output, the first input receiving the first output signal of the second signal preprocessing circuit, the second input receiving the synthesizer signal, the output being connected to the transmission bandpass filter such that the transmission bandpass filter produces an output signal representing the transmission pilot tone.

12. The system as claimed in claim 7, wherein the demodulation device comprises:

an I/Q demodulator producing an I signal and a Q signal; and first and second output paths respectively for the I signal and the Q signal;

a capacitor connected between each output path and the I/Q demodulator.

13. The system as claimed in claim 12, wherein the first and the second output paths of the demodulation device each comprise:

an inverter;

a bandpass filter;

a changeover switch controlled by the pseudo noise signal, having an output connected to the bandpass filter and being switchable between first and second inputs, the first input being connected to the inverter, the second input being connected to the l/Q demodulator; and an analog-digital converter, with the I signal and the Q signal, respectively, being passed either via the inverter or directly to the low-pass filter via the changeover switch as a function of the pseudo noise signal which controls the changeover switch.

14. The system as claimed in claim 8, wherein the first signal preprocessing circuit comprises a series circuit formed by a first amplifier, a first bandpass filter, a second amplifier, a limiter and a second bandpass filter.

15. The system as claimed in claim 14, wherein the second signal preprocessing circuit comprises a mixer, an oscillator, a doubler and a bandpass filter arranged in series in that order, the mixer has two inputs and produces a first output signal, the two inputs of the mixer are connected respectively to an output signal of the oscillator and to the pseudo noise signal, the first output signal from the mixer is applied to the transmission circuit, and the bandpass filter produces a second output signal, which is applied to the demodulation device.

16. The system as claimed in claim 15, wherein the reception bandpass filter and the transmission bandpass filter have a pass band from 935 to 960 MHz, the bandpass filters in the first signal preprocessing circuit have a bandwidth of 1.6 MHz, the low-pass filters in the output paths of the demodulation device have a cut-off frequency of 30 Hz, the synthesizer has synthesizer signals at a frequency of 824 MHz or 850 MHz, the clock signal for the synthesizer and for the pseudo noise generator is at a frequency of 1 MHz, the output signal from the receiving mixer is at a frequency of 110.6 MHz, the bandpass filter in the second signal preprocessing circuit has a pass frequency of 221 MHz, and the signal from the oscillator is at a frequency of 110.6 MHz.

17. The system as claimed in claim 1, wherein the antenna system is a phased array antenna system with N individual antennas, a Butler matrix is used for driving N individual antennas and is connected between the N feeder cables and the N individual antennas.

18. The system as claimed in claim 2, wherein the input device comprises:

a switch with an input for receiving the transmission pilot tone and N outputs, which are respectively allocated to the N feeder cables; and a coupler for inputting the transmission pilot tone, into the appropriate feeder cable, the coupler receiving the transmission pilot tone and being connected downstream from each of the N outputs of the switch.

19. A system for chase trimming of N feeder cables, which are used for driving an antenna arrangement, by a transmission pilot tone, comprising:

a trimming device connected to a first end of the feeder cables, to correct phase differences between the N feeder cables;

an input device connected to the trimming device to successively input a transmission pilot tone to the first end of the N feeder cables via the trimming device;

a transmission device to which the N feeder cables are connected via the trimming device and the input device;

an output device connected to a second end of the N feeder cables, between the N feeder cables and the antenna system, to output the transmission pilot tone as a received pilot tone; and a detection unit to detect phase differences between the N feeder cables using the received pilot tone so that phase differences can be corrected by the trimming device, wherein the trimming device has a controllable phase control element for phase trimming, associated with each of the respective N feeder cables, wherein the input device comprises:

a switch with an input for receiving the transmission pilot tone and N outputs, which are respectively allocated to the N feeder cables; and a coupler for inputting the transmission pilot tone, into the appropriate feeder cable, the coupler receiving the transmission pilot tone and being connected downstream from each of the N outputs of the switch, wherein the output device comprises:

N couplers, which are respectively associated with the N feeder cables for outputting the received pilot tone from the N feeder cables;

a combiner connected the the N couplers, to combine the pilot tone received from the N feeder cables and produce a combined signal; and a pilot tone device to receive the combined signal for further signal processing.

20. The system as claimed in claim 19, wherein the pilot tone device comprises:

a pilot tone input connected to the combiner to receive the combined signal; and a pilot tone output connected to the input device for feeding the transmission pilot tone into the input device.

21. The system as claimed in claim 20, further comprising:

a monitoring device connected downstream from the pilot tone device to receive data from the pilot tone device; and a local maintenance terminal which is connected to the monitoring device, to detect phase differences between the feeder cables.

22. The system as claimed in claim 1, wherein the transmission pilot tone is an analog transmission pilot tine.

* * * * *